United States Patent [19]

Sochor

[11] 4,140,361

[45] Feb. 20, 1979

[54] FLAT RECEPTACLE CONTACT FOR EXTREMELY HIGH DENSITY MOUNTING

[76] Inventor: Jerzy R. Sochor, 164 Rockview, Irvine, Calif. 92715

[21] Appl. No.: 751,010

[22] Filed: Dec. 13, 1976

Related U.S. Application Data

[63] Continuation of Ser. No. 584,477, Jun. 6, 1975, abandoned.

[51] Int. Cl.[2] ..... H01R 13/12; H01R 33/76

[52] U.S. Cl. ..... 339/258 P; 339/176 M

[58] Field of Search ..... 339/176, 192, 258, 256, 339/259

[56] References Cited

U.S. PATENT DOCUMENTS

| | | | |
|---|---|---|---|
| 3,732,529 | 5/1973 | Weisenburger | 339/258 P |
| 3,865,462 | 2/1975 | Cobaugh et al. | 339/176 M |
| 3,867,008 | 2/1975 | Gartland, Jr. | 339/258 R |
| 3,876,274 | 4/1975 | Ruehlemann et al. | 339/258 R |
| 3,955,869 | 5/1976 | Licht | 339/258 P |

FOREIGN PATENT DOCUMENTS

| | | | |
|---|---|---|---|
| 1901466 | 11/1970 | Fed. Rep. of Germany | 339/258 P |
| 1374648 | 8/1964 | France | 339/258 R |
| 48997 | 6/1966 | German Democratic Rep. | 339/258 R |

*Primary Examiner*—Neil Abrams
*Attorney, Agent, or Firm*—David Pressman

[57] ABSTRACT

High contact density post and blade electrical receptacles for edge-mount semiconductor packages or like substrate carried circuits comprise an insulator housing retaining a plurality of contacts having substantially planar construction and providing redundant electrical connections with the mating post or blade.

10 Claims, 12 Drawing Figures

FLAT RECEPTACLE CONTACT FOR EXTREMELY HIGH DENSITY MOUNTING

This is a continuation of my copending application Ser. No. 584,477, filed June 6, 1975, and now abandoned.

BACKGROUND AND BRIEF SUMMARY OF THE INVENTION

A 0.100" contact spacing within a single row is considered the present practical limit for standard spacing in existing miniature electrical connectors.

Recently designers have been increasing number of functions per electronic package; this, together with space and speed requirements of many applications, has forced into existence connectors with higher density contact spacing, such as 0.050" within a single row.

However, severe physical constraints of such spacing have made it difficult to produce reliable and economic connectors.

The object of this invention is to achieve the contact reliability, mechanical integrity, and economy of standard spacing connectors, such as 0.100", in higher density spacing connectors, such as 0.050", 0.0375", or even less, to which this invention specifically but not exclusively relates.

Two rows of contacts having mating means on 0.050" pitch within each row can be further interlaced to provide an effective edge spacing of 0.025".

This invention provides high contact density receptacle connectors for mating with blade contacts, which can be utilized for disengageably connecting substrate-mounted electronic devices to a printed wiring board.

The term "substrate" as used in this specification, broadly encompasses ceramic substrates, printed circuit boards, flexible circuits or cables or any panel member provided with electrical conductors in either wired or printed form.

The term "blade contact" encompasses square and rectangular posts and thin metal flat or formed blades.

Another object of this invention is to provide a simple and versatile resilent coupling contact means which can be mounted on an extremely small pitch and adapted to numerous applications by providing suitable extensions to the mating means.

One such extension to the blade contact is a solder or a pressfit and solderless wrap tail, and for the receptacle contact a cantilever tab terminal means for resilently receiving a module package board.

A basically planar construction of the receptacle contacts, characterized by lack of severe forming operations between the blank stage and the final stage in a progressive contact-forming die, affords an efficient stock to scrap ratio and good tolerance control since the functional dimensions are blank dimensions and only minor forming operations are required to convert the blank to a finished part.

The lack of severe forming operations such as right angle folds, permits use of highest strength contact spring materials since the strip temper does not have to be compromised by elongation requirements.

The planar construction of receptacle contacts is particularily suitable for mounting on a small pitch.

In addition, an efficient space utilization along the pitch is effected by mutually offsetting the free end noses of the cantilever mating means including the contact areas on their apexes, (called load points throughout this specification), horizontally side by side, or vertically to different levels and correspondingly profiling the surrounding insulator partitions. The offsetting of the load points of the resilent cantilever mating means also permits using a very thin metal mating blade and contact preload since the limitations associated with ordinary post receptacles having mutually opposing cantilever load points are absent.

While in the ordinary contact a minimum gap has to exist for plating and cleaning requirements and is difficult to control as a result of folds, the planar contacts with offset cantilevers afford a negative effective gap whose magnitude can be precisely controlled.

A still further object of this invention is to provide high module board retention force by permanently but replaceably driving the substrate between two rows of metal cantilever tabs extending upwardly from the receptacle means and outwardly above the insulator housing. This effects high pressure registrations on the substrate pads and permits infra-red reflow-soldering, visual inspection of registration, and on-duty contact probing.

One cantilever tab of each common pair makes electrical contact with the pad on the component side of the package substrate, the other tab providing back-up means and, if desired, serving as a jumper to the other side of the substrate.

The tails of successive contacts can be alternately rotated in the housing 180 degrees to plug into an offset hole pattern in the circuit board.

Similarly, the substrate receiving cantilever tabs can be made to project by uneven distances to further stratify the connections in order to improve registration and relax tolerancing.

DESCRIPTION OF THE PREFERRED EMBODIMENTS

Figure 1:
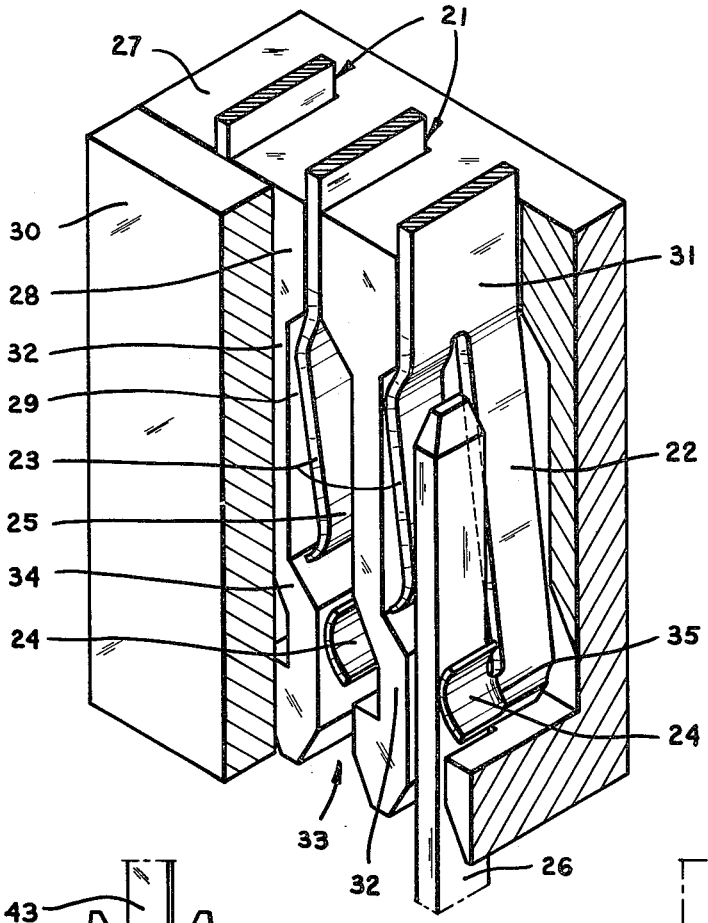
FIG. 1 is a perspective view of the contact mating means shown with a supporting insulator in a high contact density arrangement.

FIG. 1 shows the preferred embodiment of a high contact density connector employing receptacle contacts 21, each having resilent, fully independent cantilevers 22 and 23 with vertically offset free end noses 24 and 25, having load points on their convex sides for making a two-sided disengageable connection with a mating blade contact 26.

The contacts are side loaded into insulator housing 27, from side 28 into apertures 29. Side wall 30 is added to fully enclose contacts 21 and retain the contacts from their shank portion 31 to its adjacent legs.

The minimum pitch at which contacts 21 are installable is determined by the width requirement of aperture 29 and the minimum successfully moldable wall thickness of partition 32. The width of aperture 29 which is required to house mated contact pairs is minimized by routing cantilever leg 22 adjacent a nonmating side of the engaging blade 26 contact rather than in the conventional manner, i.e., adjacent to its mating side. Only the free end nose 24 of cantilever leg 22, including its load point, is brought to the side of the mating blade passageway just above its protective lead-in 33, but it is vertically offset from the free end portion 25 of the other cantilever leg 23 so that it does not increase the aperture width requirement.

Stated otherwise, by offsetting the mating portions of the cantilever legs vertically, i.e., in the direction of mating, the contact can be made substantially flatter in its horizontal dimension (i.e., parallel to the directions in which the mating surfaces face and flex), for the same electrical and mechanical characteristics, than if the mating portions were aligned vertically.

The partition wall 32 between adjacent contacts is profiled to surround the contacts with minimum operating clearance and is stepped at 34 corresponding to the vertically offset cantilever free end portions, thus optimizing space utilization in the direction of contact mounting pitch.

The free end portion 24 of cantilever leg 22 is also shown stepped at 35 to reduce its space requirement and to increase the lead-in engagement between the lead-in portion of cantilever leg 22 and its mating blade.

Figure 2:
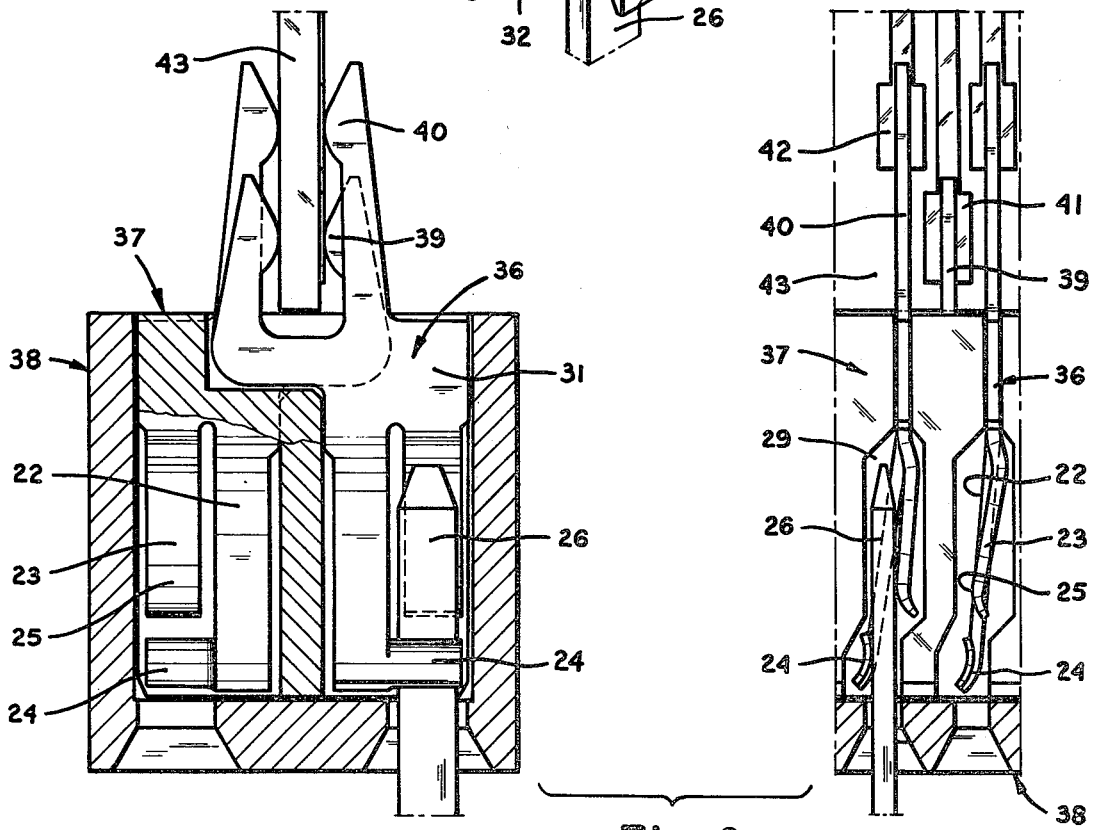
FIG. 2 illustrates an application of the arrangement of FIG. 1 to an edge-mount receptacle connector.

FIG. 2 shows an application of the principle of the contact of FIG. 1 to an edge-mount receptacle connector.

Contacts 36 are side-loaded into a center insulator 37 and the thus obtained sub-assembly is inserted into an outer insulator 38 and retained therein.

The two rows of identical contacts 36 are oppositely oriented so that the substrate edge receiving means, which extend upwardly from shank portions 31, interlace centrally in the connector, yielding spacing equal to one-half of a single row contact pitch. For example, if the contacts within each row are on a 0.050" pitch, the substrate receiving means will be on a 0.025" pitch.

The two common substrate receiving cantilever tabs of each contact project upwardly by uneven distances so that when the successive contacts are alternately rotated 180 degrees, tabs 39 and 40 of successive contacts on the circuit side of the substrate will correspondingly and alternately register on different level pads 41 and 42 deposited on substrate 43.

Figure 3:
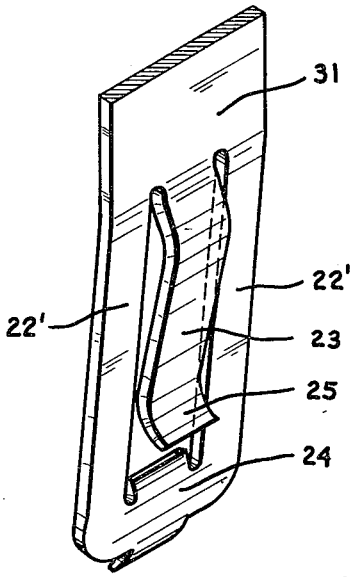
FIGS. 3 and 4 are perspective views of alternative constructions of receptacle contacts having vertically offset resilent cantilever load points.

FIG. 3 shows an alternative planar receptacle contact which is derived from receptacle contact 21 of FIG. 1 by the addition of resilent strap 22'.

Figure 4:
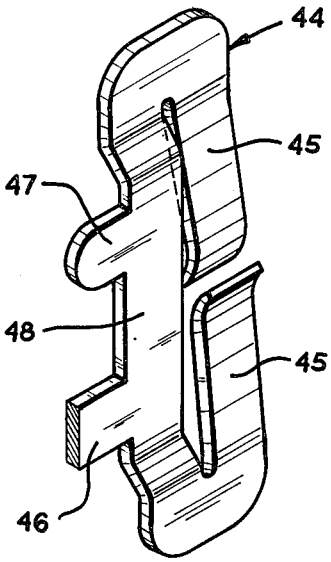

FIG. 4 shows a perspective view of an alternative receptacle contact 44 having vertically offset resilient mating means 45. A portion of a tail 46 and a stabilizing tab 47 are shown projecting from a bridging strap 48.

Figure 5:
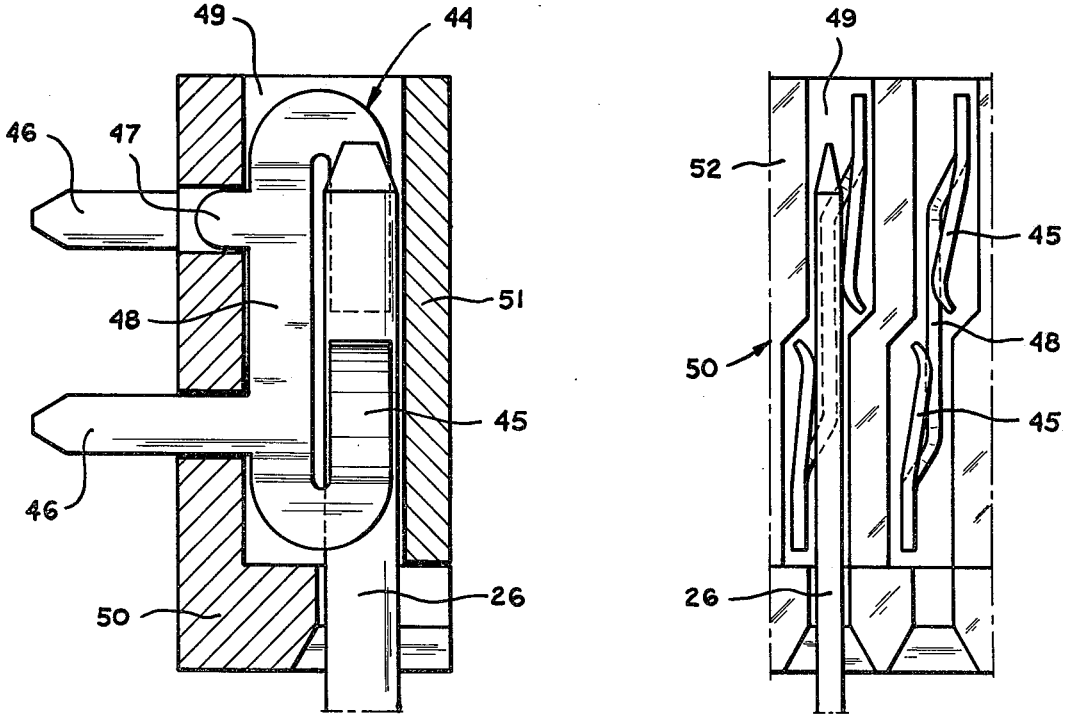
FIG. 5 illustrates an application of the contact of FIG. 4 to a solder-tab receptacle connector for use with a printed board.

In FIG. 5 there is shown a solder-tab printed circuit board connector comprising plurality of contacts 44 side entered into apertures 49 of insulator 50, alternately rotated 180 degrees, and retained therein by a side wall 51 which is bonded to a side 52 of insulator 50.

Figure 6:
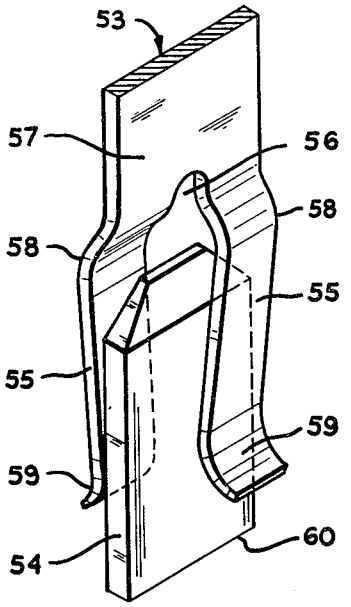
FIG. 6 is a perspective view of a receptacle contact with horizontally offset resilent cantilever load points.

FIG. 6 shows an alternative construction of a planar receptacle contact 53 in resilent two-sided engagement with a blade contact 54.

The two resilent cantilevers 55, having substantially similar spring parameters, are separated by a bifurcation slot 56 centrally located in the wide or planar side of contact 53 and are offset from the plane of shank 57 in mutually opposite directions, defining a passageway for the mating blade which is situated below shank 57 in the same vertical plane.

Prior to engagement, the resilent cantilever noses 59 protrude into the mating blade's passageway, the amount of protrusion determining the amount of resilent deflection imposed by the mating blade 54.

If in their free state the engaging noses protrude beyond the connection symmetry plane, a negative gap condition results, whereby the total resilent deflection created by the mating blade is greater than the blade's thickness.

The contact of FIG. 6 can be adapted to various applications by suitably extending shank 57 and end 60 of mating blade 54. One such application is an edge-mount receptacle connector depicted in FIG. 7 in which shank 57 is extended into cantilever tabs 61 for resilently receiving a circuit substrate.

The blade contact has a solderable or solderless wrap tail 62 which is offset relative to the mating blade in order to achieve a staggered tail pattern.

In order to fully realize the highest possible contact density, contacts 53 are mounted into insulator 63 its wide, or planar, side, transversely to the insulator's longitudinal axis.

Furthermore, cantilevers 55 of receptacle contact 53 are confined in corresponding aperture pockets 64 which are conformally asymmetrically configured and mutually transversely spaced by a distance equal to the width of bifurcation slot 56 less the operating clearance, thus creating the ability to use a stepped insulating partition 65 between adjacent apertures and permitting placing the adjacent apertures in close longitudinal proximity or mutual overlap.

A damage-proof entry opening is achieved without using protective insulation in front of the cantilever's free end noses 59 since the entering blade is prevented from deviating from proper mating position by the restrictive passageway between each two aperture pockets 64.

Contact retention bars **57*a* forcibly engage the insulator, providing retention, and contact centering is assured by restrictive chamfers 66**.

Figure 8:
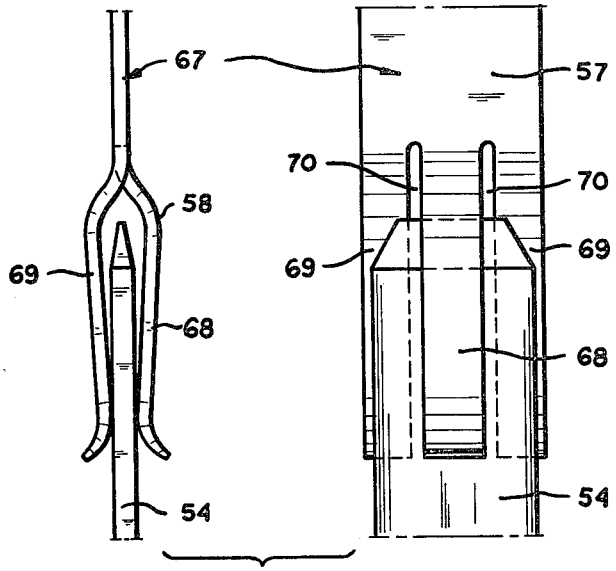
FIG. 8 is an alternative construction of a receptacle contact with horizontally offset resilent cantilever load points.

FIG. 8 shows an alternative configuration of receptacle contact 67 in which a center resilent cantilever leg 68 makes connection to one side of mating pin 54 and two side cantilever legs 69 make connections to the other side of mating pin 54.

To balance the contact forces on both sides of the mating pin, the width of center cantilever leg 68 can be made twice the width of each side cantilever leg 69.

Figure 7:
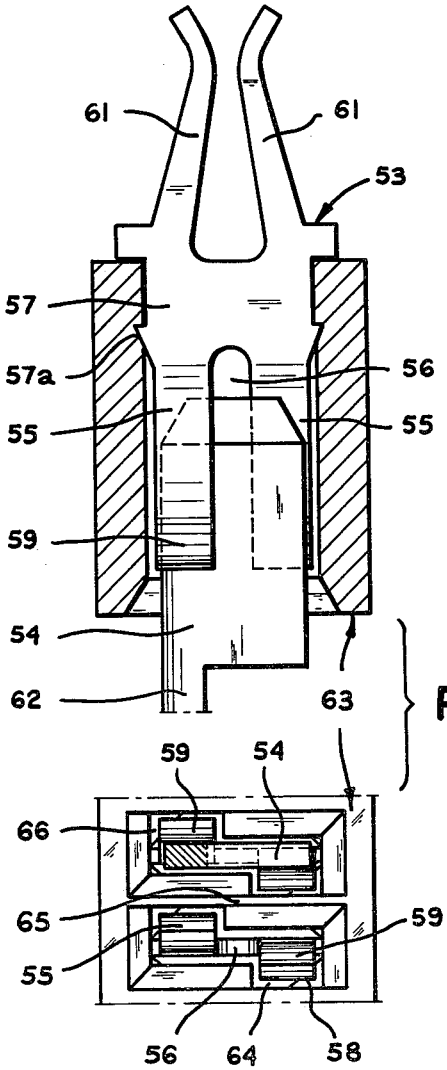
FIG. 7 illustrates an application of the contact of FIG. 6 to an edge-mount receptacle connector.

Each slot 70 could be made as wide as the bifurcation slot in the contact 53 (FIG. 6) if a high contact mounting density similar to that illustrated in the FIG. 7 is to be employed.

Figure 9:
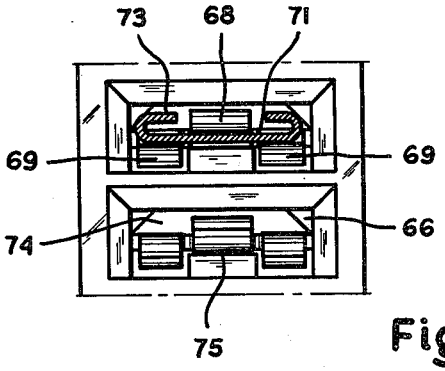
FIG. 9 illustrates an alternative use of the receptacle contact of FIG. 8.
Figure 10:
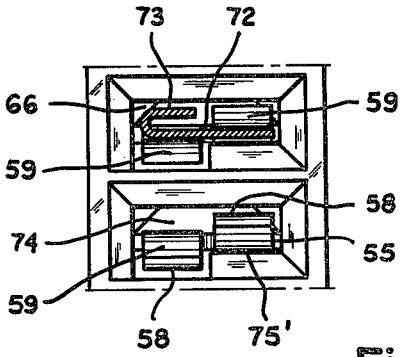
FIG. 10 illustrates an alternative use of the receptacle contact of FIG. 6.

In FIGS. 9 and 10, which provide a bottom view of the receptacle of FIG. 7, planar contacts of the types shown in FIGS. 8 and 6, respectively, are shown in alternative high contact density engagement with very thin mating blades 71 and 72.

In this case, slots 56 and 70 must only minimally functionally separate the adjacent cantilevers and may be extended only where this separation is not achieved by offset 58, namely, on the distance by which resilent cantilever noses mutually interlace.

The interlacing overlap of resilent cantilever noses, corresponding to a negative gap condition, makes the planar contacts particularily suitable for engagement with very thin mating blades, thus resulting in a decreased minimum mounting pitch requirement for the mated contact means.

Mating blades 71 and 72 are reinforced by stiffening forms 73, configured not to demand increased pitch space but rather to fully utilize the available insulator aperture space 74 to the side of the resilent cantilevers, and also to enable a damage proof entry without protective insulation.

In FIG. 9, a blade contact having a C-shaped cross-sectional profile cooperates with a "C"-shaped outline of the insulator aperture to provide a damage-proof entry and so that upon engagement, stiffening forms 73 occupy spaces 74 adjacent the sides of resilent cantilever leg 68.

The load point 75 of leg 68 is shown preloaded against the aperture wall it faces.

In FIG. 10, the blade contact's cross-sectional profile is "J"-shaped and cooperates with a "J" or "L"-shaped insulator aperture to provide a damage proof entry and so that upon engagement, the blade's stiffening extension 73 occupies space 74, adjacent the side of resilent cantilever 55.

Cantilever leg 55 is shown preloaded against the insulator's aperture wall at 75'.

A second stiffening extension (not shown) can be added to blade 72, assymmetrically to the existing one, so that the blade's cross-sectional profile would be "S"-shaped and the cooperating insulator aperture would be substantially rectangular.

Figure 11:
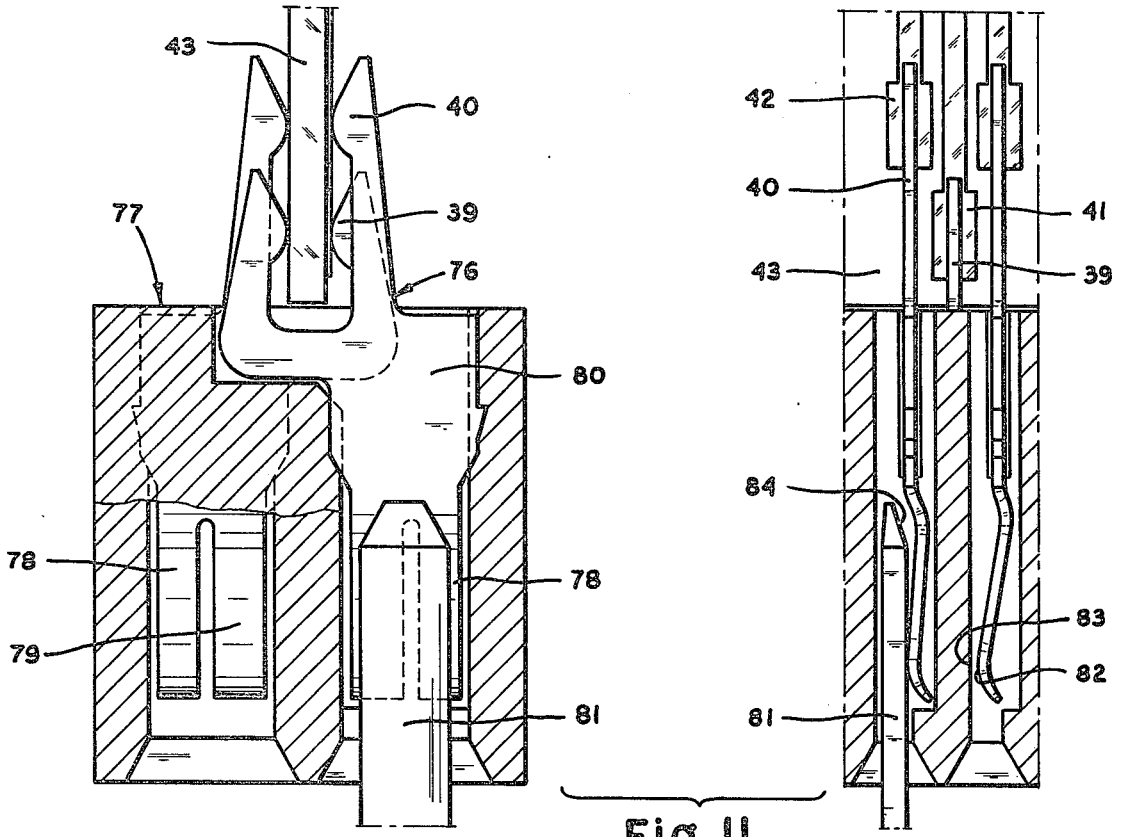
FIGS. 11 and 12 illustrate alternative embodiments of the edge-mount receptacle connector of FIG. 2.

In FIG. 11 there is shown a planar receptacle contact 76 used in an edge-mount connector embodiment similar to that of FIG. 2.

The contacts 76 are forcibly installed in one piece insulator housing 77 from its top side as seen in FIG. 11, the two rows oppositely oriented so that the substrate edge receiving means interlace centrally in the connector, yielding spacing equal to one-half of the contact spacing within each row.

The receptacle contact 76 has resilent cantilevers 78 and 79 which extend downwardly and co-planarly, side by side, from an offset shank portion 80 and provide two one-sided connections to the engaging side of mating blade 81.

The redundancy is further assured by making the resilent cantilevers 78 and 79 of unequal width, thus differentiating their natural frequency response in vibration environments.

If a relatively thin blade is used, the resilent cantilever load points 82 can be preloaded against the aperture wall 83 they face and the blade contact's lead-in chamfer can be made more generous on the blade contact's mating side 84.

Figure 12:
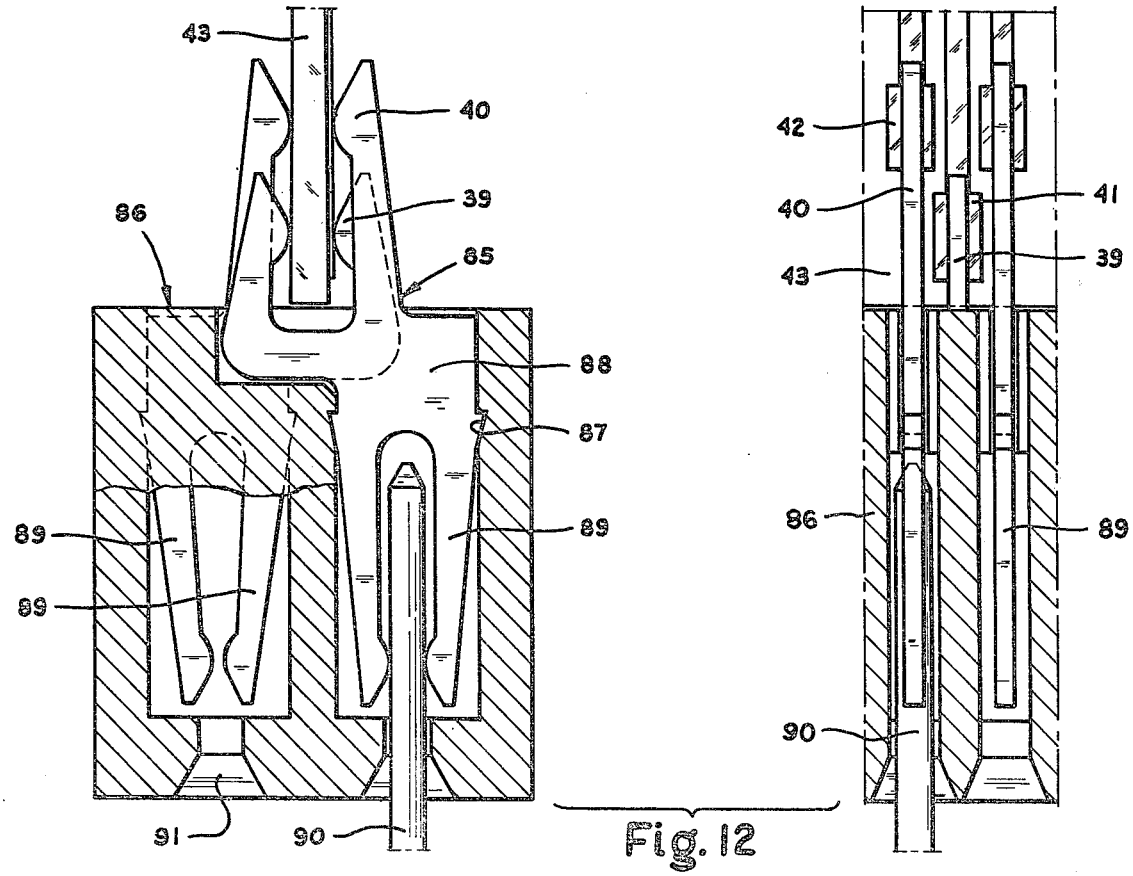

In FIG. 12 there is shown still another embodiment of the connector of FIG. 2.

A tuning fork type mating means are employed in the planar contact 85, which is forcibly installed in one piece insulator housing 86 from its top side as seen in FIG. 12, and retained therein by retention barbs 87 extending sideways from contact shank 88.

The resilent mating cantilevers 89 are shown in engagement with blade contact 90, which is received from the connector's bottom side through a protective lead-in opening 91.

While I have illustrated and described this invention with respect to several embodiments, they cannot be exhaustive because of the multitude of connector applications to which a basic pair of contact mating means can be adapted. A basic pair of mating contacts should be understood to encompass a receptacle contact's resilent mating means up to its sustaining shank and the blade contact's mating portion, not including extensions thereof.

I claim as new:

1. A receptacle contact comprising:

a generally flat elongated sheet metal member aligned in a direction of mating and having a body portion and a plurality of cantilever legs which extend from said body portion and are parallel to said direction of mating, said legs and said body portion all lying generally in a first plane parallel to said direction of mating, said legs being defined by at least one coplanar slot in said sheet metal member, an end part of each of said legs being formed so as to provide a convex mating surface thereat, said legs being oriented so that their direction of elongation is parallel to said direction of mating, and so that when a male contact is inserted between said legs in said direction of mating, said legs will deflect in respective planes perpendicular to said first plane, said legs being shaped and dimensioned so that (1) the respective convex mating surfaces at the ends of said legs face in opposite directions so as to be able to engage opposite sides of a male contact when inserted between said mating surfaces along said direction of mating, (2) said mating surfaces are in alignment, located one directly above the other along said direction of mating when viewed perpendicularly to both said first plane and said direction of mating so as to be able to engage opposite sides of said male contact when inserted between said mating surfaces in said direction of mating and the direction of elongation of said legs, and (3) said mating surfaces are spaced apart in said direction of mating so as to be able to engage said male contact at respectively different axial parts thereon, said legs having different lengths and extending in a common direction from said body portion, the longer leg having an ear portion extending over and toward the axis of the shorter leg from an end part of said longer leg, said ear portion having said convex mating surface thereon, said contact being made substantially flatter, in its dimension perpendicular to said first plane, than it could be for the same electrical and mechanical characteristics if said mating surfaces were not spaced apart in said direction of mating.

2. The contact of claim 1 further including an integral strap portion connecting the end of said ear portion distal from said longer leg to said body portion, said strap portion being elongated and oriented in said direction of mating.

3. The contact of claim 1 further including an insulator housing having said contact mounted therein, and further including a plurality of additional contacts mounted therein such that said contacts are closely spaced and lie generally on planes which are parallel, thereby to form a high contact mounting density receptacle.

4. The contact of claim 3 wherein said insulator housing includes means for prestressing each of the legs of said contact in a direction opposite to the direction in which said mating surface of each of said legs faces.

5. The contact of claim 1 wherein said legs are shaped such that when said contact is in an unmated state, said mating surfaces have a negative gap therebetween when measured in a direction parallel to the directions in which said mating surfaces face.

6. The contact of claim 1 wherein corresponding portions of said legs are separated by a coplanar bifurcating slot so that an edge of each corresponding portion faces an edge of the other corresponding portions across said slot.

7. The contact of claim 1 wherein said legs are shaped to form only a single thickness of said sheet metal, when viewed in a direction perpendicular to said first plane, for at least substantially all portions of said legs.

8. A receptacle contact comprising:

a generally flat elongated sheet metal member aligned in a direction of mating and having a body portion and a plurality of cantilever legs which extend from said body portion and are parallel to said direction of mating, said legs and said body portion all lying generally in a first plane parallel to said direction of mating, said legs being defined by at least one coplanar slot in said sheet metal member, an end part of each of said legs being formed so as to provide a convex mating surface thereat, said legs being oriented so that their direction of elongation is parallel to said direction of mating, and that when a male contact is inserted between said legs in said direction of mating, said legs will deflect in respective planes perpendicular to said first plane, said legs being shaped and dimensioned so that (1) the respective convex mating surfaces at the ends of said legs face in opposite directions so as to be able to engage opposite sides of a male contact when inserted between said mating surfaces along said direction of mating, (2) said mating surfaces are in alignment, located one directly above the other along said direction of mating when viewed perpendicularly to both said first plane and said direction of mating so as to be able to engage opposite sides of said male contact when inserted between said mating surfaces in said direction of mating and the direction of elongation of said legs, and (3) said mating surfaces are spaced apart in said direction of mating so as to be able to engage said male contact at respectively different axial parts thereon, said body portion being elongated and oriented in said direction of mating, said legs extending from opposite ends of said body portion toward each other, the base of each leg being connected to said body portion by an offset portion, said contact being made substantially flatter, in its dimension perpendicular to said first plane, than it could be for the same electrical and mechanical characteristics if said mating surfaces were not spaced apart in said direction of mating.

9. The contact of claim 8 wherein said legs have equal lengths.

10. The contact of claim 8 wherein said legs are shaped to form only a single thickness of said sheet metal, when viewed in a direction perpendicular to said first plane, for at least substantially all portions of said legs.

* * * * *